United States Patent [19]

Rogers

[11] 4,408,707

[45] Oct. 11, 1983

[54] REVOLVER RELOADER HOLSTER

[75] Inventor: William H. Rogers, Jacksonville, Fla.

[73] Assignee: Rogers Holster Co., Inc., Jacksonville, Fla.

[21] Appl. No.: 310,796

[22] Filed: Oct. 13, 1981

[51] Int. Cl.[3] ..... F42B 39/04; F42B 39/00

[52] U.S. Cl. ..... 224/239; 42/89; 224/240

[58] Field of Search ..... 224/196, 223, 239, 235, 224/236, 240, 241, 242, 237, 911, 203; 42/89

[56] References Cited

U.S. PATENT DOCUMENTS

| | | | |
|---|---|---|---|
| 109,365 | 11/1870 | King | 224/223 |
| 527,166 | 10/1894 | Watson | 42/89 |
| 1,781,816 | 11/1930 | Jovino | 224/223 |
| 2,349,107 | 5/1944 | Murtaugh | 224/239 |
| 2,399,904 | 5/1946 | Baucum | 42/89 |
| 2,592,415 | 4/1952 | Grogan | 224/239 |
| 2,620,584 | 12/1952 | Edmands | 42/89 |
| 2,837,259 | 6/1958 | Blanchard | 224/242 |
| 3,542,263 | 11/1970 | Callahan | 224/237 |
| 3,702,671 | 11/1972 | Cirillo | 224/242 |
| 3,769,733 | 11/1973 | Nelson | 224/239 |
| 3,777,954 | 12/1973 | Theodore | 224/239 |
| 3,977,516 | 8/1976 | Tilve | 224/240 |
| 4,262,833 | 4/1981 | DeSantis | 224/239 |
| 4,272,903 | 6/1981 | Griffis | 42/89 |

*Primary Examiner*—Allan N. Shoap
*Assistant Examiner*—Robert Petrik
*Attorney, Agent, or Firm*—Arthur G. Yeager

[57] ABSTRACT

A holster for a cartridge reloader for a revolver which includes a molded leather body having a front, back, top, bottom, two sides, and a flap extending downwardly from the top and overlapping the front and attachable thereto by a snap fastener. The holster also has an interior cavity adapted to fit closely around the reloader when positioned with the bases of the cartridge cases adjacent the top and the bullets adjacent the bottom, and the sides of the holster being open sufficiently to permit a belt to be threaded therethrough with the belt extending between opposed pairs of bullets and the forward portion of the reloader resting on the belt.

12 Claims, 7 Drawing Figures

REVOLVER RELOADER HOLSTER

BACKGROUND OF THE INVENTION

Persons armed with revolvers, such as policeman, military men, etc., normally must carry extra ammunition on a belt in which each cartridge is contained in a separate loop on a belt. Consequently, the reloading of a revolver was time consuming since it was necessary to remove six cartridges separately and individually from the belt and insert them one at a time into the recesses of the cylinder of the revolver. This operation takes much more time than is desirable, particularly if one's life might depend upon speedy reloading. In recent times a cylindrical clip has been developed to hold revolver cartridges in a configuration which would permit all of them to be inserted simultaneously into the cyinder of a revolver. These devices, commonly called "speedloaders", are readily available commercially. Such clips are bulky and prior to this invention, could not be carried very conveniently. Furthermore, in the case of officers of the law who carry concealed arms the speedloader has not been easy to conceal.

It is an object of this invention to provide a holster for the speedloader. It is another object of this invention to provide a holster which can be attached to the belt in such a fashion that it does not produce a noticeable protruding bulge when that person is wearing a jacket. It is still another object of this invention to provide a molded leather holster for this purpose which is not sensitive to moisture. Still other objects will be apparent from the more detailed description of this invention which follows.

BRIEF SUMMARY OF THE INVENTION

This invention provides a holster for a cartridge reloader for a revolver comprising a molded leather body having a front, a back, a top, a bottom, two sides, and a flap extending downwardly from the top and overlapping the front and attachable to the front by means of a releasable fastening device. The holster has an interior cavity adapted to fit closely around the reloader when positioned with the base of the cartridges adjacent to the top and the bullets of the cartridges adjacent to the bottom, and the sides of the holster are open sufficiently to permit a belt to be threaded therethrough with the forward edge of the reloader resting on the top edge of the belt. In specific embodiments of this invention the molded leather is a laminate of a layer of leather and a layer of thermoplastic material.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawing in which:

DETAILED DESCRIPTION OF THE INVENTION

Figure 1:
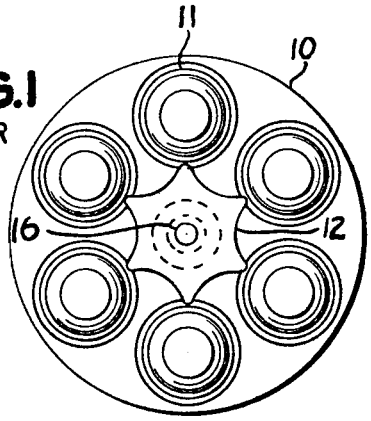
FIG.1 PRIOR ART
FIG. 1 is a top plan view of a prior art reloader containing six cartridges.
Figure 2:
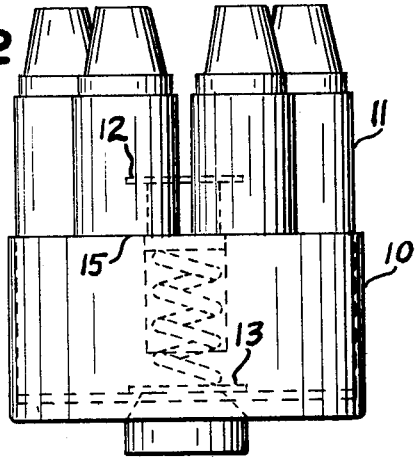
FIG.2 PRIOR ART
FIG. 2 is a side elevational view of the prior art reloader and cartridges OF FIG. 1.

There are available on the current market several types of devices for holding cartridges in circular arrangement such that they all may be simultaneously and rapidly loaded into a revolver. Such a device is referred to herein as a "reloader" and a typical version of which is shown in FIGS. 1 and 2, commonly called a "speedloader". The device involves a plastic body 10 having cavities arranged in a cylindrical configuration to hold the necessary cartridges for reloading a revolver. Usually revolvers contain six cartridges but reloaders are available for revolvers containing other than six cartridges. In FIG. 1 there are shown six cartridges 11 seated with the base of the cartridge at the bottom of body 10 and the bullet end of the cartridge projecting upwardly. Cartridges 11 are held in place by the action of upper retainer 12 and lower retainer 13. When the reloader of FIG. 1 is used to reload a revolver the bullet ends of the cartridges are inserted into the cylinder of the revolver causing a central pin on the cylinder to press against recess 16 causing retainers 12 and 13 to release the cartridges from body 10. Other types of reloaders accomplish the same result in different ways.

Figure 3:
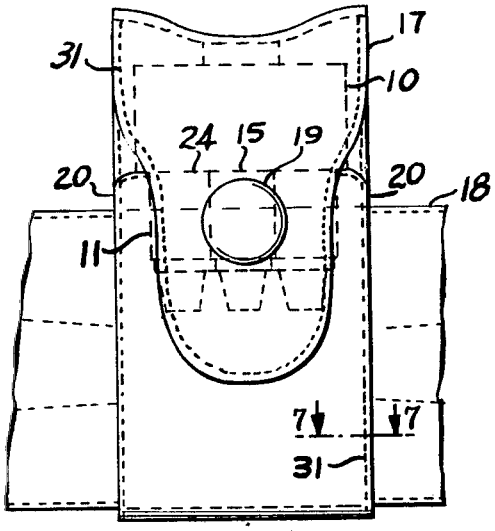
FIG. 3 is a front elevational view of the holster of this invention mounted on a belt, with the prior art reloader encased therein.
Figure 4:
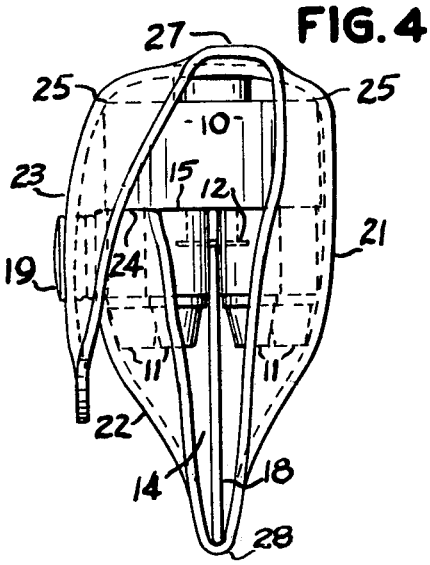
FIG. 4 is a side elevational view of the holster and reloader of FIG. 3.
Figure 5:
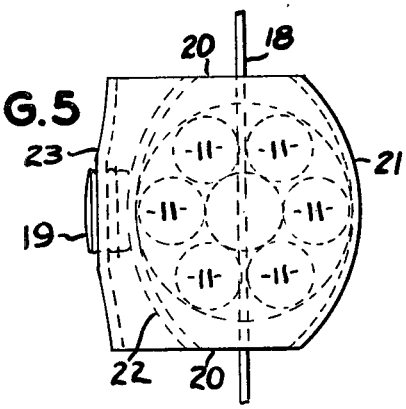
FIG. 5 is a top view of the holster and reloader of FIG. 3.

The holster of this invention which is employed to house a speedloader containing six cartridges is shown in FIGS. 3,4, and 5. Holster 17 comprises a single strip of molded leather having a back 21, a front 22, a top 27, a bottom 28, and two open sides 20. The strip is folded at top 27 and at bottom 28 to produce an interior cavity for containing the speedloader body 10 and cartridges 11 in a position such that the base of the cartridges is adjacent top 27 and the bullet end of cartridges 11 is adjacent bottom 28. Flap 23 extends downwardly from top 27 overlapping front 22, and is attached thereto by means of a releasable fastening device 19, shown here as a snap fastener.

Holster 17 is molded in accordance with the procedure described in my patent application Ser. No. 129,174, filed Mar. 10, 1980, entitled "METHOD OF PRODUCING A MOISTURE-INSENSITIVE MOLDED LEATHER HOLSTER". In general, that procedure involves preparing a laminate of a layer of leather or leather-like material, and a layer of thermoplastic material, cutting it into the shape to produce the holster, heating the laminate to the softening temperature of the thermoplastic material, inserting a core of the general shape of the reloader and cartridges shown in FIGS. 1 and 2, pressing the laminate against the core to mold the laminate to the configuration of the core, and holding the laminate in that position while the laminate is cooled to ambient temperature. The originally flat laminate is thereby molded to fit snugly around the core, gripping the core around rearward edge 25, cartridges 11, and pressing top edge 24 of front 22 against forward edge 15 of body 10, while leaving narrow openings 14 on sides 20 sufficiently wide at the top to permit fingers to grip body 10. Holster 17 is made sufficiently long, i.e. between top 27 and bottom 28, that an ordinary trouser belt 18 may be threaded through openings 14 and between cartridges 11 with the forward edge 15 or upper retainer 12 of the reloader resting on the top of belt 18. This positioning on belt 18 places half of the holster and its contents on the inside of the belt resting against the body of the wearer leaving only an unobstrusive bulge outside of the belt. As may be seen in FIG. 5 belt 18 is threaded through the middle of the group of cartridges 11 such that three of cartridges 11 are outside of the belt and three of cartridges of 11 are inside the belt. Of course, if a five-cartridge reloader were used either two or three cartridges would be located outwardly or inwardly of the belt.

It is seen that in FIGS. 1, 4 and 5 that the reloader is of the type having a plurality of chambers for holding cartridges with the chambers being disposed on both sides of a longitudinal plane passing through the longitudinal axis of the reloader and the chambers being substantially parallel to the longitudinal axis.

Figure 7:
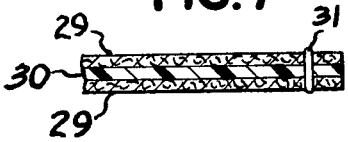
FIG. 7 is a cross-sectional view taken at 7—7 of FIG. 3.

The general structure of the material used to make holster 17 is shown in FIG. 7 in its preferred embodiment comprising two outer layers of leather, or leather-like material, 29 and a central layer of thermoplastic material 30. It is preferred to employ this arrangement so that there is soft leather against the body of the wearer and against the reloader and its cartridges. Laminates which consist of a single layer of leather, or leather-like material, and a single layer of thermoplastic material are completely satisfactory for preparing the molded leather holster of this invention, regardless of whether the layer of leather is on the outside against the body of the wearer or on the inside against the reloader and cartridges. It is preferred, however, to employ a laminate of two outer layers of leather, or leather-like material, and a central layer of thermoplastic material so as to provide soft leather against the body of the wearer and against the cartridges and reloader. In order to insure against separation of the laminated layers as well as to provide a desirable appearance, the laminate is normally stitched around the edges of the strip of molded leather as indicated at 31 in FIG. 3.

Figure 6:
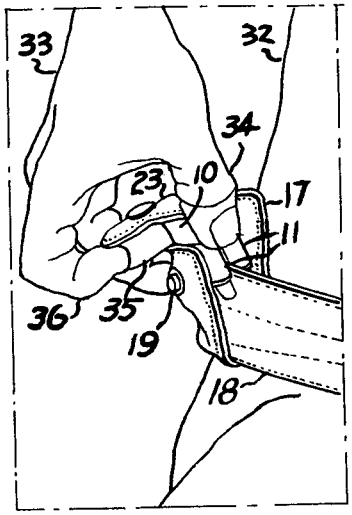
FIG. 6 is a schematic illustration of the manner in which the reloader is removed from the holster of this invention while attached to a belt.

In FIG. 6 there is shown the manner in which the holster of this invention provides easy and rapid access to the reloader for loading the cylinder of a revolver. Holster 17 containing reloader 10 and cartridges 11 is attached to belt 18 as described with respect to FIGS. 3,4, and 5. The person 32 wearing holster 17 grasps the opposite sides of body 10 with thumb 34 and second finger 35 while unsnapping fastener 19 and lifting flap 23 with index finger 36 permitting holder 10 and cartridges 11 to be readily lifted out of holster 17. Thus, in one quick move of hand 33 the reloader can be grasped and the holster simultaneously opened to permit removal of the reloader and insertion of the cartridges into the cylinder of the revolver where they are automatically released to fall into the separate chambers of the cylinder.

While the invention has been described with respect to certain specific embodiments it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A holster for a cartridge reloader for a revolver, the reloader being of the type having a plurality of chambers for holding cartridges with the chambers being disposed on both sides of a longitudinal plane passing through the longitudinal axis of the reloader and the chambers being substantially parallel to the longitudinal axis, said holster comprising a body having a front, a back, a top, a bottom, two sides, and a flap extending downwardly from said top and overlapping said front, and fastening means for releasably attaching said top to said front; said holster having an interior cavity adapted to fit closely around the reloader when positioned with the base of the cartridges adjacent said top and the bullets of the cartridges adjacent said bottom, said sides of said holster having opening means open sufficiently to permit a belt to be threaded therethrough below said reloader and to permit grasping of the reloader while unfastening said fastening means, said opening means and said cavity being related so that said belt separates generally half of said cartridges of said reloader on either side of said belt to provide enhanced unobtrusiveness of said reloader and holster when worn.

2. The holster of claim 1 wherein said sides provide a wider opening adjacent said top and a narrower opening adjacent said bottom.

3. The holster of claim 1 wherein said front, said back, said top, said bottom, and said flap comprise a single piece of molded leather or leather-like material.

4. The holster of claim 1 wherein said fastening means includes snap fastener.

5. The holster of claim 1 wherein said reloader includes a body for holding said cartridges and said body has a forward edge positioned downwardly in said holster and resting on said front.

6. The holster of claim 5 wherein said reloader body rests on the top edge of said belt.

7. The holster of claim 1 wherein said reloader is a generally cylindrical container holding several cartridges in a cylindrical configuration.

8. A holster for a reloader for a revolver, the reloader being of the type having a plurality of chambers for holding cartridges with the chambers being disposed on both sides of a longitudinal plane passing through the longitudinal axis of the reloader and the chambers being substantially parallel to the longitudinal axis, said holster comprising a strip of material having a top transverse fold and spaced therefrom a bottom transverse fold with one end of said strip extending upwardly from said bottom fold to form the front of said holster and the other end of said strip extending downwardly from said top fold to form a flap overlapping said front, a releaseable fastening device for selectively unfastening said flap from said front, said holster when said flap is fastened having an interior cavity which is adapted to fit snugly around the reloader with the bullet ends of the cartridges pointing towards said bottom fold, said holster having two opposite side openings communicating said interior cavity with the outside of said holster and adapted to have a belt threaded therethrough for attachment of said holster to the belt with the belt supporting the reloader, said belt separating generally half of said cartridges of said reloader on either side of said belt to provide enhanced unobtrusiveness of said reloader and holster when worn, said belt providing support for said reloader even after release of said fastening device, said side openings being sufficiently large that the reloader may be manually gripped on both sides of said holster while simultaneously unfastening said flap to permit withdrawal of the reloader from its supported position on said belt and from said holster.

9. The holster of claim 8 wherein said fastening device is a snap fastener.

10. The holster of claim 8 wherein said reloader contains six cartridges arranged in a cylindrical configuration.

11. The holster of claim 8 wherein said side openings are larger adjacent said top fold and narrower adjacent said bottom fold.

12. The holster of claim 8 wherein said front fits snugly around said cartridges and abuts the forward edge of said reloader.

* * * * *